US005927691A

United States Patent [19]

Ottemann

[11] Patent Number: 5,927,691

[45] Date of Patent: Jul. 27, 1999

[54] FOUR SPEED SAILBOAT WINCH HAVING SEPARATE SECOND GEAR

[75] Inventor: William C. Ottemann, Fallbrook, Calif.

[73] Assignee: Harken, Inc., Pewaukee, Wis.

[21] Appl. No.: 08/254,978

[22] Filed: Jun. 7, 1994

[51] Int. Cl.[6] ..... B66D 1/22

[52] U.S. Cl. ..... 254/344; 475/12

[58] Field of Search ..... 254/342, 344, 254/371; 475/12

[56] References Cited

U.S. PATENT DOCUMENTS

| | | | |
|---|---|---|---|
| 3,927,580 | 12/1975 | Fawcett | 254/344 X |
| 3,962,935 | 6/1976 | Hutton et al. | 254/344 X |
| 4,111,397 | 9/1978 | Bonassi | 475/12 X |
| 4,944,195 | 7/1990 | Takahashi et al. | 475/12 X |
| 5,370,366 | 12/1994 | Ottemann | 254/343 |

FOREIGN PATENT DOCUMENTS

| | | | |
|---|---|---|---|
| 2109489 | 6/1983 | United Kingdom | 475/12 |

*Primary Examiner*—Donald P. Walsh

*Assistant Examiner*—Emmanuel M. Marcelo

*Attorney, Agent, or Firm*—Juettner Pyle Piontek & Underwood

[57] ABSTRACT

The features of a known auto shifting three speed winch having a drive shaft and rotatable drum are used to provide first, third and fourth gears upon reversal of rotation of the drive shaft. The third and fourth gears use common gearing and the final gear meshed with the drum. A separate drive train is provided for second gear and includes planetary gears having carriers secured to the drum and operating between a sun gear on the shaft and an outer ring gear. Second gear is selected by means of pawls brought into engagement with a ratchet track on the ring gear, with the pawls being connected to torsion springs controlled manually by a lever arrangement. When second gear is engaged, the winch can shift between only second and third, with fourth being overridden.

13 Claims, 4 Drawing Sheets

FOUR SPEED SAILBOAT WINCH HAVING SEPARATE SECOND GEAR

BACKGROUND OF THE INVENTION

This invention relates to multiple speed winches having two separate and selectively shift sequences.

Conventional multiple speed winches comprise a rotatable drum mounted on a base support and a central driven shaft connected by a gear train to an inner ring gear surface on the drum. These winches have mechanisms to enable driving of the drum in a clockwise direction at progressively higher gear ratios upon reversal of rotation of the drive shaft.

Four speed winches are typically employed on large sailboats for the purpose of providing different gear ranges depending on whether the boat is sailing upwind or downwind. In the former, the winch is employed to pull in the sheet of a genoa, and in the latter, the sheet of a spinnaker is wrapped around the drum of the winch. Since the boat may frequently tack when beating upwind, it is desirable to have a first gear of a high ratio, e.g., 1:1 to enable slack line to be trimmed in rapidly. As tension increases, third and fourth gears can be selected automatically by successive reversals of rotational direction of the drive shaft.

When sailing downwind, a first gear ratio of 1:1 does not provide sufficient mechanical advantage, since the sheet is under constant tension. Thus, a second gear is provided which has a gear ratio between the first and third gears. Also, means are provided to allow operation of the winch between second and third gears upon driving the drive shaft in opposite rotational directions.

U.S. Pat. No. 4,725,043 describes a four speed winch, which is in effect, a conventional three speed winch with a manually selectable second speed added to the main drive train. In first speed, the drum and shaft are driven together by a one way ratchet mechanism, by rotating the shaft in a clockwise direction. When rotation of the shaft is reversed, first speed is disengaged by a spring mechanism connected to an external central button. Upon rotation of the shaft successively in the counterclockwise and clockwise directions, third and fourth speeds are engaged. First speed may be again selected by depression of the central button.

Second speed is also manually engaged via a lever and operates through the final drive gears of the winch. While such arrangement operates successfully, it is inefficient because the relatively high second gear must drive through a long drive train through the final drive. Also, since second gear operates through the main drive train, the winch will automatically shift from second to third and then to fourth unless a separate mechanism is used to lock out fourth gear.

SUMMARY OF THE INVENTION

In accordance with the present invention, a four speed winch is provided in which first and second gears comprise drive trains which are separate and independent of the higher gearing and are located in the top of the winch. First gear is connected directly to the winch drum and automatically disconnects upon reversal of rotation of the main drive shaft, as in a conventional three speed winch. Third and fourth gears are driven through a common drive train in a conventional manner in the base of the winch.

Second gear comprises a sun gear on the main drive shaft, and a plurality of planetary gears meshed between the sun gear and an outer ring gear. The planetaries have carriers secured to the top wall of the drum.

The ring gear has an outer ratchet track, and spring loaded pawls, supported from the winch housing, are engageable with the track to prevent rotation in one direction. The pawls are connected to one end of a torsion spring, with the other end being connected to a lever. The lever is rotated between two positions in which the pawls are either completely disengaged from the ratchet track or are in operative engagement therewith.

When second gear is selected, the pawls engage the ratchet track and prevent rotation of the ring gear in a counterclockwise direction. Thus, the planetary gears drive the winch in the second drive ratio. Third gear is automatically engaged upon reversal rotation of the drive shaft. In this mode, only second and third gear are available, since fourth gear is overridden by second and therefore unavailable. First gear may also be reengaged in this mode.

When the second gear pawls are disengaged from the ring gear, then the winch is automatically shiftable between first, third and fourth in a manner similar to a conventional three speed winch.

In summary, features of a conventional auto shifting three speed winch are employed to provide first, third and fourth gears, in which first gear is connected directly to the drum, and third and fourth gears are geared to the drum through a common drive train and to a common final gear meshed with the drum. Second gear is provided through separate planetary gearing connected to the top of the drum and operates independently of the other gearing when second gear is selected.

The four speed winch of the present invention is more efficient than four speed winches known in the prior art. Since second gear has an independent drive train, the gearing is direct and most efficient at the desired gear ratio. If second gear was driven through the final gears, it would be necessary to employ inefficient gearing in order to speed up the gears in the final drive.

In addition, the use of a torsion spring to engage and disengage the ratchets from the ratchet track offers a considerable improvement over mechanical devices used in the prior art.

DESCRIPTION OF THE PREFERRED EMBODIMENTS

Figure 1:
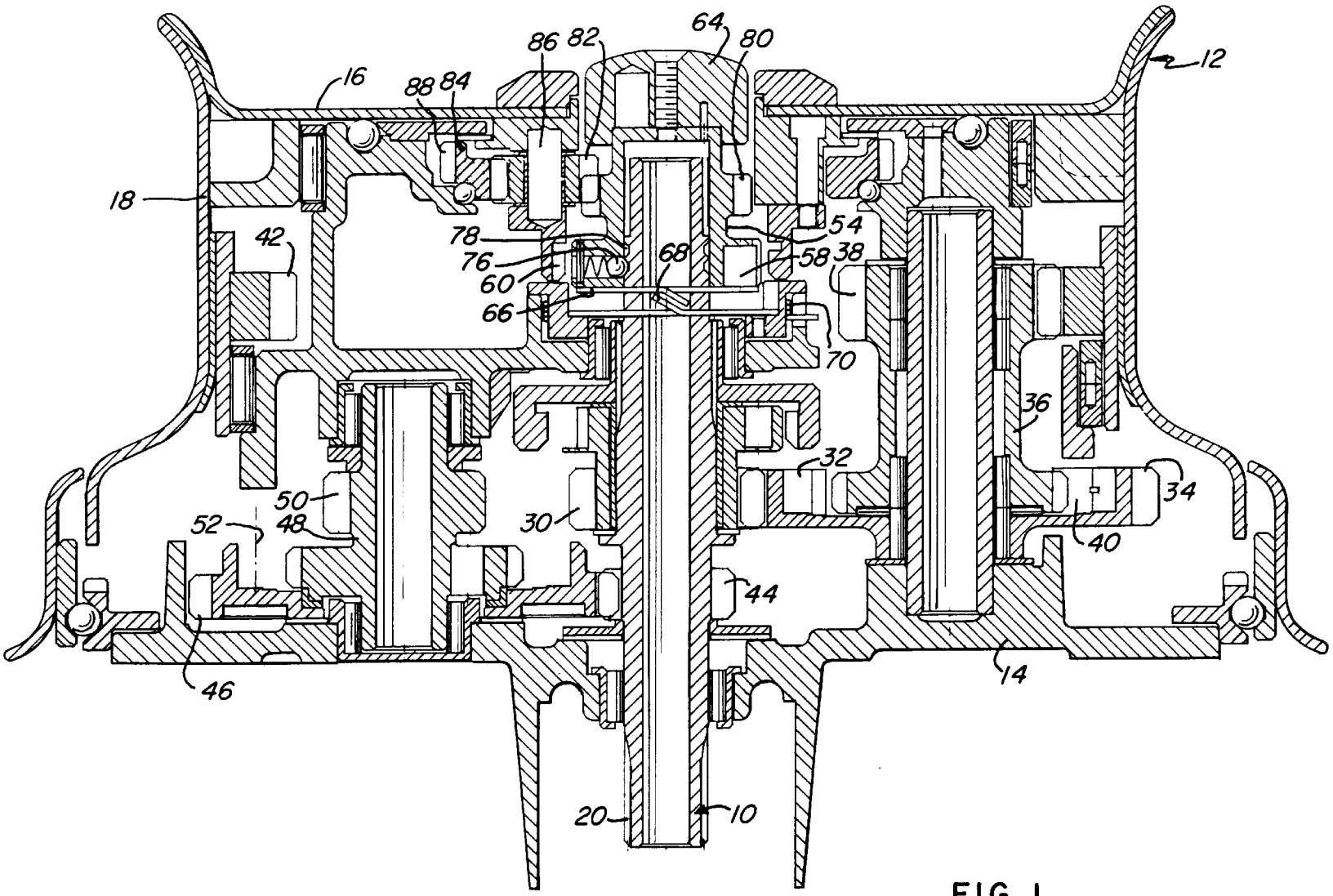
FIG. 1 is a vertical sectional view of the four speed sailboat winch of the present invention.
Figure 2:
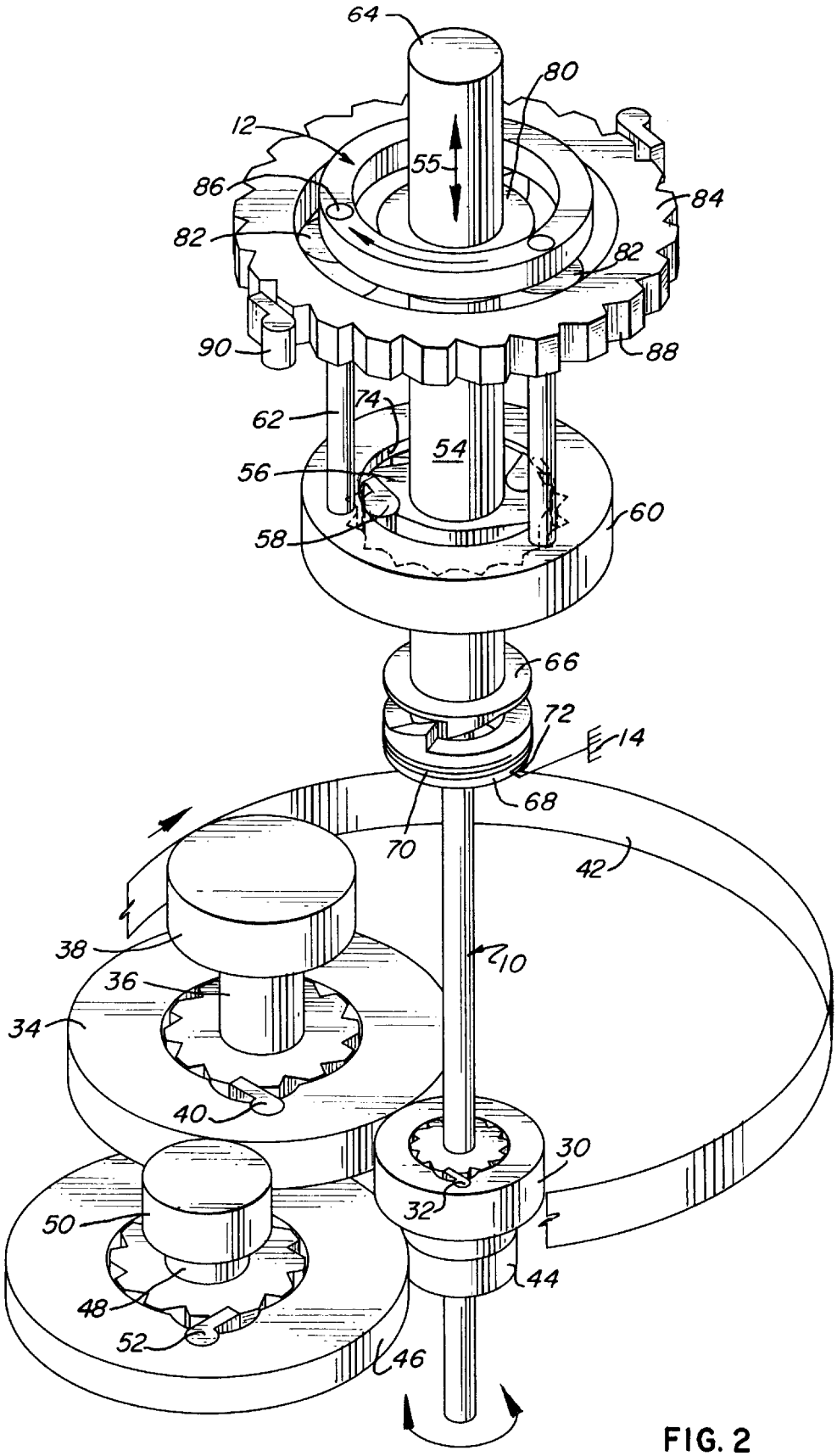
FIG. 2 is a perspective schematic view of the winch shown in FIG. 1, with the main drive shaft being elongated for better clarity of the component parts.
Figure 3:
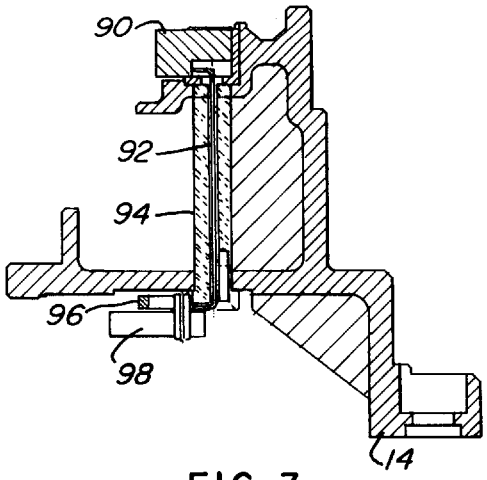
FIGS. 3 and 4 are partial sectional views through other portions of the winch shown in FIG. 1, illustrating the torsion spring loaded pawl for second gear and its associated operating mechanism.
Figure 4:
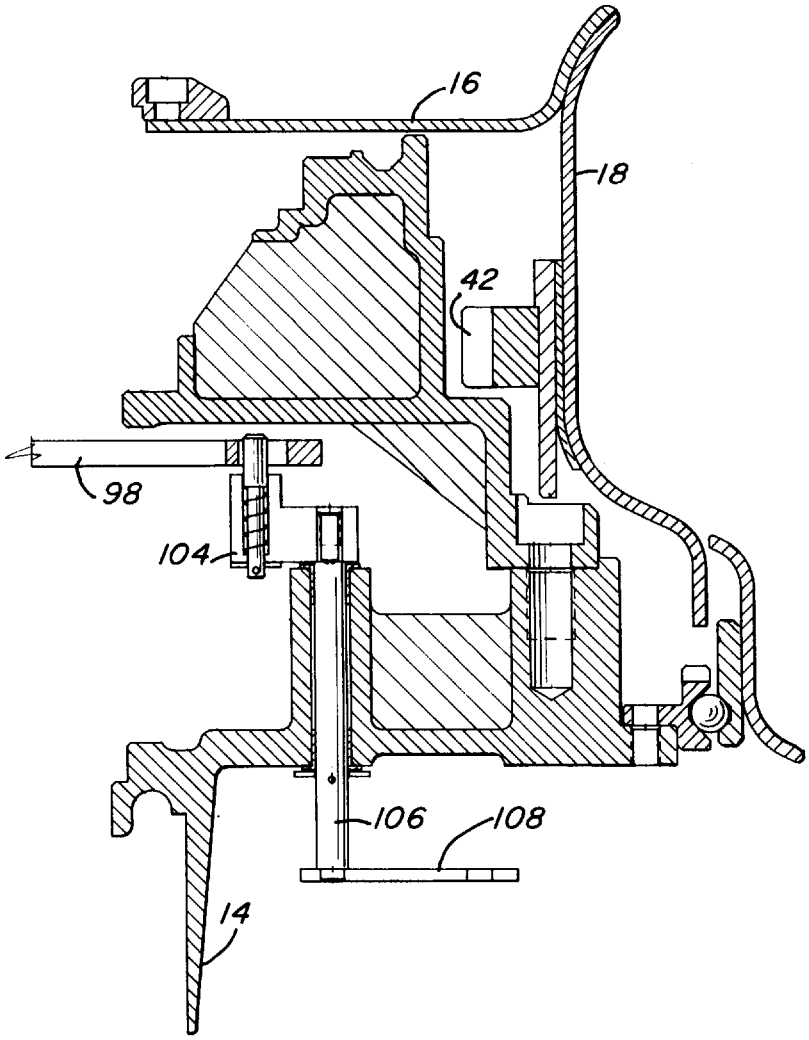

FIGS. 1 and 2 show the preferred form of the four speed winch, in which a main central drive shaft 10 is driven in both rotary directions in order to drive an outer drum 12 through a range of four speeds in a clockwise direction.

The winch of the present invention has features in common with multiple speed winches of the prior art, and will not be described in detail. The winch includes, for example, a pedestal support 14 adapted to be secured to the deck of a sailboat. The drum 12 includes an upper wall 16 in the form of a disk and a cylindrical side wall 18 around which the end of a line is wrapped when the winch is operated. Also, as well known in this art, the rotatable parts of a winch are supported by bearings as shown in FIG. 1 in a conventional fashion.

The main drive shaft 10 for the winch has a splined lower end 20 adapted to be connected by a suitable transmission and routed to a manually operated crank mechanism (not shown) at a separate location. The winch may also be operated by an electric or hydraulic motor or by a crank connected to the top of the drive shaft. Also, for the sake of clarity, the gear surfaces of the meshing gears shown in FIG. 2 have been omitted. As in the case of all conventional sailboat winches, rotation of the drum is allowed or possible in the clockwise direction when the winch is viewed from the top, regardless of which gear may be engaged. Rotation of the drum in the counterclockwise direction is always prevented by ratchet mechanisms associated with the gears. The pawls have been omitted in FIG. 1 for the sake of clarity. Also, as shown in FIG. 2, the input to the main drive shaft 10 for first, second and fourth gears is in the clockwise direction, and for third only in the counterclockwise direction.

Based on the initial assumption that first and second gears are disengaged, the drive train for third and fourth gears will be described.

The drive train for third gear comprises a first pinion 30 secured on the main shaft 10 and having a ratchet mechanism 32 in driving relation between the shaft and gear in a counterclockwise direction, with the first pinion being meshed with a driven gear 34 connected by a shaft 36 to a final gear 38. There is a ratchet mechanism 40 between shaft 36 and driven gear in driving engagement in the clockwise direction. The final gear 38 is meshed with an internal ring gear 42 on the drum 12. The ratchet mechanisms are conventional spring loaded pawls in engagement with a circular one-way toothed ratchet track. Depending on orientation, the pawls are in driving engagement in one rotational direction but ride over the track in the other direction or when overridden by a lower gear. Rotation of shaft 10 and pinion 30 in a counterclockwise direction causes rotation of gears 34 and 38 in a clockwise direction, serving to drive the winch in third gear.

Fourth gear is established through a drive train to final gear 38, said drive train comprising a second pinion 44 secured on the shaft 10 and being meshed with a driven gear 46 connected by a shaft 48 to a gear 50 meshed with driven gear 34. A ratchet mechanism 52 is provided between driven gear 46 and shaft 48 which is in driving engagement in the counterclockwise direction. Rotation of shaft 10 in the clockwise direction causes rotation of gears 46 an 50 in a counterclockwise direction, which in turn, rotate gears 34, 38 and ring gear 42 in a clockwise direction.

It will be understood, therefore, that third and fourth gears operate through a common gear train to the final gear 38 and are automatically selected upon reversal of rotation of the shaft 10 when higher gears are not engaged. In prior art four speed winches, second gear would also be connected to the drive train, which is not the case with the present invention.

First gear is established by making a direct connection between the shaft 10 and the drum 12 in a 1:1 ratio, in an upper portion of the winch. First gear is manually selectable and operates with the shaft 10 turnig in a clockwise direction. When rotation of shaft 10 is reversed the winch automatically shifts into third, and first is permanently disengaged until again manually selected.

As shown, a secondary shaft 54 is coaxially splined to the upper portion of shaft 10 and is axially movable with respect to the main shaft, as shown by the arrow 55 in FIG. 2. A pawl carrier 56 is secured to secondary shaft 54 and has two spring loaded pawls 58 in driving engagement with a circular ratchet track 60 in the clockwise direction. The track 60, in turn, is secured to the top wall of the drum 12 by means of structure or supports 62.

The outer end of secondary shaft 54 terminates in a manual button 64 extending from the top of the winch drum with the button and secondary shaft being pushed down to engage first gear.

The means to automatically disengage first gear include a pair of facing circular ramps 66 and 68, one (66) being connected to the bottom end of secondary shaft 54 and the other (68) being rotatably mounted on the main shaft 10. The lower ramp 68 has a spring clutch in the form of a spring 70 wrapped around an annular portion of the ramp 68 and having one end 72 secured to the winch base support or pedestal 14.

When first gear is engaged, the ramps can engage, with the lower ramp being freely rotatable with the shafts rotating in a clockwise direction. When rotation is reversed, the spring 70 on the lower ramp 68 engages therewith, preventing rotation in the counterclockwise direction. The ramp surfaces then move across each other, causing secondary shaft 54 to move upwardly. In so doing, the pawls 58 move out of engagement out of the geared portion of the ratchet track and onto contact with a smooth cylindrical surface 74, whereby the pawls remain inoperative until the button 64 is again depressed. As shown in FIG. 1, the secondary shaft 54 may be provided with a spring loaded ball 76 engageable with spaced detents 78 in the main shaft 10 to resiliently hold the assembly in the engage and disengage positions.

Second gear comprises a sun gear 80 secured to the secondary shaft 54, and a plurality of planetary gears 82 rotatably meshed between the sun gear and an inner meshed surface of an outer ring gear 84. The planetary gears 82 are rotatably mounted on carriers 86 secured to the top wall of the winch drum 12. The outer edge of ring gear 84 has a ratchet track 88. Pawls 90, supported from the pillar 14, are movable into and out of operative engagement with the ratchet track 88.

When the pawls 90 are in a disengaged position, the ring gear 84 is free to rotate, and the planetary gears 82 rotate but do not drive the drum.

It will now be understood that second gear is a separate drive geared to the drum of the winch. When second gear is engaged, the winch can only be driven in first, second and third gears, with fourth gear being overridden by the faster speed of second gear. Also, the use of more than one planetary gear provides a better or more uniform distribution of load from the shaft to the drum, with better load capacity and less wear.

When the ratchets 90 are moved completely away from the track 88, the winch can only operate automatically in the sequences of first, third and fourth, or third and fourth depending on whether the button 64 has been first depressed.

As shown in FIGS. 3–6, the shiftable pawls are carried by the base or stationary portion of the winch 14. One end of a torsion spring 92 is secured to the pawl 90, with the torsion bar or spring being carried in a tube 94 also supported in the base.

Figure 5:
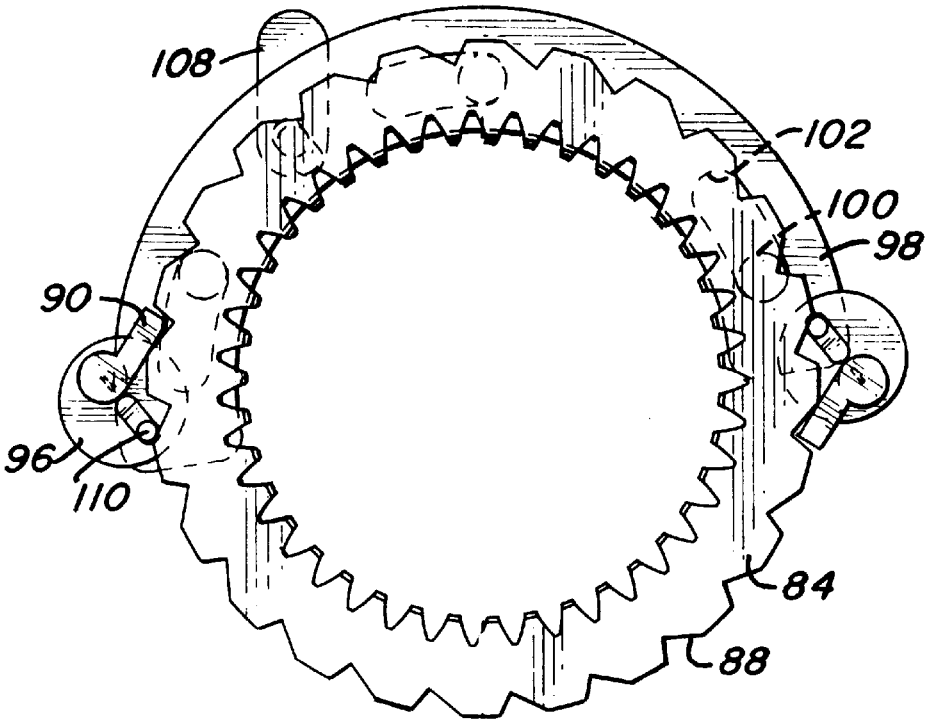
FIGS. 5 and 6 are plan views of the ring gear for second gear and associated pawls and actuator mechanism.
Figure 6:
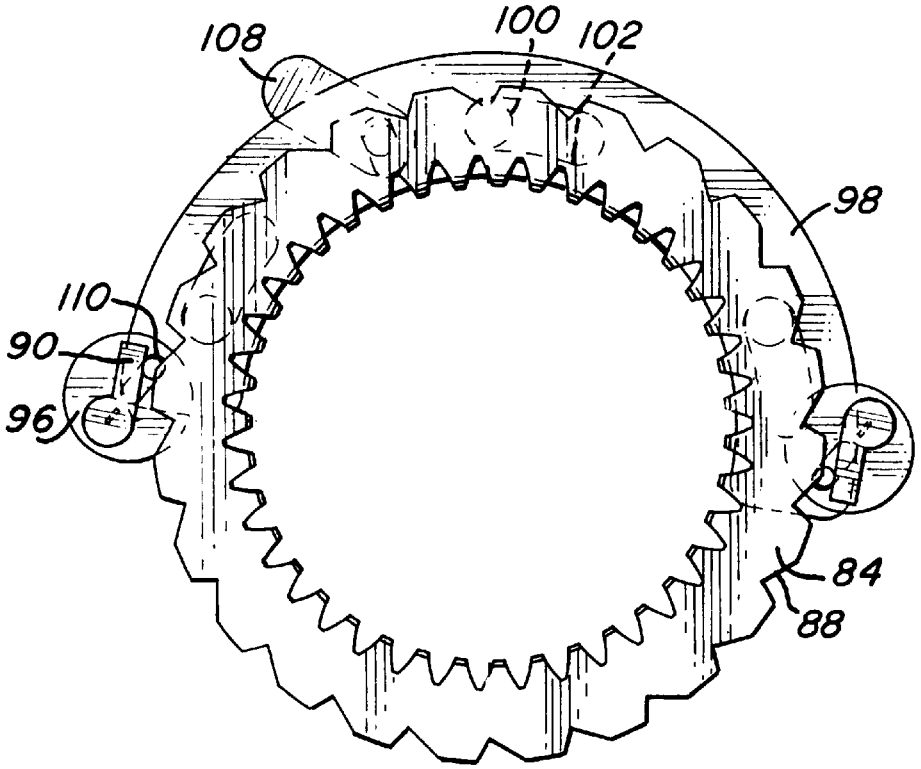

The other end of the torsion spring 92 is secured to a lever 96, which is rotated by an associated mechanism to move the ratchet 90 either out of operative engagement or in spring loaded operative engagement with the ratchet track 88. The associated mechanism includes a semi-circular actuator 98 which is carried by pins 100 in arcuate slots 102 and rotatable about the axis of the winch between the two positions shown in FIGS. 5 and 6. The actuator is pinned to a lever 104 connected to a shaft 106 leading out of the bottom of the winch and connected to an external operating lever 108. The actuator 98 has pins 110 engaging the lever 96 of the torsion spring 92. Thus, the external level 108 can be operated to move the pawls into and out of operative condition as shown in FIG. 5 (engage position) and FIG. 6 (disengage position). The external lever 108 can be connected by a suitable linkage to a convenience control device in the boat.

I claim:

1. A sailboat winch having four speeds at successively higher gear ratios comprising a support base, a drum rotatably mounted on said support base, a central rotary drive shaft extending within said drum, first drive means between said shaft and said drum for driving said drum at a first gear ratio, first drive train means between said shaft and said drum for driving said drum in a third and fourth gear at a first location on said drum, and second drive train means between said shaft and said drum, independent of said first drive train means, for driving said drum in a second gear at a second location on said drum.

2. The sailboat winch of claim 1 additionally comprising means for manually engaging and disengaging said second drive train means.

3. The sailboat winch of claim 1 wherein said second drive train comprises a sun gear secured on said shaft, a ring gear around and spaced from said sun gear, a plurality of planetary gears meshed between said sun gear and said ring gear, said planetary gears being mounted on carriers secured to the drum.

4. The sailboat winch of claim 3 wherein said carriers are secured to an upper portion of said drum.

5. The sailboat winch of claim 3 wherein said ring gear is rotatable with said planetary gears and said sun gear, and ratchet means between said ring gear and said support base for preventing rotation of said ring gear in one direction and to cause said planetary gears to move along the fixed ring gear and drive the drum in second gear.

6. The sailboat winch of claim 5 additionally comprising disengage means for manually disengaging said ratchet means from operative engagement with said ring gear.

7. The sailboat winch of claim 6 wherein said disengage means comprises a torsion spring having ends, one end being secured to said ratchet means, and means for rotating said torsion spring.

8. The sailboat winch of claim 7 wherein the means for rotating said torsion spring comprises a lever secured to the other end of said torsion spring, and means for turning said lever.

9. In a multiple speed winch comprising a support, a drum rotatably mounted on said support, a central shaft, rotatable drive means for providing at least a first and second gear between said shaft and said drum, and unidirectional drive means for permitting rotation of said drive means in only one direction, and disengage means for manually disengaging said unidirectional drive means, the improvement wherein said disengage means comprises a torsion bar having ends, one end being secured to the disengage means, and means for applying rotary torque to the other end.

10. The improvement of claim 9 wherein said disengage means comprises a movable pawl supported on said support, a ratchet track on said drive means, said one end of said torsion bar being secured to said pawl.

11. The improvement of claim 10 wherein said pawl is movable into a first position in spring loaded engagement with said ratchet track and is movable to a second position out of engagement with said ratchet track.

12. An improved four speed sailboat winch comprising a base support, a hollow drum rotatably mounted on said support, a central drive shaft in said drum rotatably mounted in said base, first drive means between said shaft and said drum for providing a first gear, and common drive train means between said shaft and said drum for providing third and fourth gears, wherein the improvement comprises second gear drive train means between said shaft and drum for providing a second gear, said second gear drive train means being separate and independent of said common drive train means, and means for engaging and disengaging said second gear drive train means.

13. The improved winch of claim 12 wherein said winch can shift automatically through the sequence of first, third and fourth with the second gear drive train means disengaged, and the winch can shift only between second and third gears with the second gear drive train means being engaged.

* * * * *